US005564931A

United States Patent [19]

Fabian et al.

[11] Patent Number: 5,564,931

[45] Date of Patent: Oct. 15, 1996

[54] CARD EDGE CONNECTOR USING FLEXIBLE FILM CIRCUITRY

[75] Inventors: David J. Fabian, Mount Joy; Michael A. Viselli, Middletown; John E. Westman, Harrisburg, all of Pa.

[73] Assignee: The Whitaker Corporation., Wilmington, Del.

[21] Appl. No.: 248,121

[22] Filed: May 24, 1994

[51] Int. Cl.[6] ..... H01R 9/09

[52] U.S. Cl. ..... 439/62; 439/67

[58] Field of Search ..... 439/62, 67, 632

[56] References Cited

U.S. PATENT DOCUMENTS

| | | | |
|---|---|---|---|
| 3,102,767 | 9/1963 | Schneck . | |
| 3,401,369 | 9/1968 | Palmateer et al. . | |
| 3,609,463 | 9/1971 | Laboue | 317/101 DH |
| 3,614,707 | 10/1971 | Kaufmann et al. . | |
| 3,665,370 | 5/1972 | Hartmann . | |
| 3,697,929 | 10/1972 | Konewko et al. . | |
| 3,772,775 | 11/1973 | Bonnke et al. | 29/628 |
| 3,922,054 | 11/1975 | Dechelette . | |
| 4,221,448 | 9/1980 | Logerot et al. . | |
| 4,266,839 | 5/1981 | Aikens . | |
| 4,327,955 | 5/1982 | Minter . | |
| 4,373,764 | 2/1983 | Ulrich . | |
| 4,517,625 | 5/1985 | Frink et al. | 361/399 |
| 4,626,056 | 12/1986 | Andrews, Jr. et al. . | |
| 4,629,270 | 12/1986 | Andrews, Jr. et al. . | |
| 4,655,462 | 4/1987 | Balsells | 277/164 |
| 4,840,575 | 6/1989 | Matsuoka | 439/267 |
| 4,894,022 | 1/1990 | Guckenheimer | 439/260 |
| 4,904,197 | 2/1990 | Cabourne | 439/260 |
| 4,911,643 | 3/1990 | Perry et al. | 439/67 |
| 4,911,653 | 3/1990 | Walton et al. | 439/326 |
| 4,925,400 | 5/1990 | Blair et al. | 439/374 |
| 4,934,942 | 6/1990 | Casciotti | 439/67 X |
| 4,968,265 | 11/1990 | Fox, Jr. | 439/197 |
| 4,969,824 | 11/1990 | Casciotti | 439/62 |
| 5,002,496 | 3/1991 | Fox, Jr. | 439/197 |
| 5,044,980 | 9/1991 | Krumme et al. | 439/67 X |
| 5,080,595 | 1/1992 | Mouissie | 439/67 |
| 5,098,309 | 3/1992 | Deak et al. | 439/260 |
| 5,133,667 | 7/1992 | Daughtrey | 439/67 |
| 5,156,553 | 10/1992 | Katsumata et al. | 439/62 |
| 5,161,981 | 11/1992 | Deak et al. | 439/66 |
| 5,171,154 | 12/1992 | Casciotti et al. | 439/67 |
| 5,176,349 | 1/1993 | Bendorf | 248/220.2 |
| 5,195,897 | 3/1993 | Kent et al. | 439/67 |
| 5,273,450 | 12/1993 | Renn et al. | 439/260 |
| 5,308,257 | 5/1994 | Buchter et al. | 439/267 |
| 5,316,486 | 5/1994 | Tanaka et al. | 439/67 X |
| 5,378,161 | 1/1995 | Loder | 439/62 X |
| 5,496,182 | 3/1996 | Yasumura | 439/62 |

OTHER PUBLICATIONS

The Whitaker Corporation Case No. 15735.

*Primary Examiner*—P. Austin Bradley
*Assistant Examiner*—Daniel Wittels
*Attorney, Agent, or Firm*—Katherine A. Nelson

[57] ABSTRACT

A surface mountable card edge connector 10 includes a housing 16 having a transverse base 18 and opposed end-walls 28; a generally C-shaped outer shell member 44; a generally C-shaped inner support member 60; two resilient members 76 disposed in channels 74 defined between portions of the shell and support members 44,60; and a flexible film circuit assembly 80. Free ends 56 of the shell member 44 define a card receiving slot 58 of selected width greater than the thickness of a card 112 insertable thereinto. Facing portions 78 of each the resilient members 76 extend into the card receiving slot 58. The film assembly 80 is disposed in a loop extending into the card receiving slot 58 and around the sides 19 of the shell member 44 such that exposed circuitry 88,90 at selected regions of the film assembly 80 is located in the card receiving slot 58 and proximate the resilient members 76. Upon inserting a circuit board 112 having circuit pads 114 thereon in registry with the circuitry of the film assembly 80 into the card receiving slot 58, the resilient members 76 provide normal force to maintain electrical interconnection therebetween.

16 Claims, 7 Drawing Sheets

CARD EDGE CONNECTOR USING FLEXIBLE FILM CIRCUITRY

FIELD OF THE INVENTION

This invention relates to card edge connectors and more particularly to surface mountable card edge connectors using flexible film circuitry.

BACKGROUND OF THE INVENTION

The use of flexible film circuitry i.e., circuitry disposed on a thin insulating material such as polyimide polyester, or the like, to interconnect one circuit array with another array to provide a means to achieve extremely high density interconnections is known in the art. Flexible film circuitry is particularly suitable for use when dealing with dense arrays of circuits having closely spaced centerlines. The circuitry on the film is easily reconfigurable and the film provides a seamless extension from the mother board to a daughter card.

U.S. Pat. No. 3,922,054 discloses one early use of flexible film with a zero insertion force (ZIF) card edge connector in which a flexible circuit is looped around a channel and held taught against it by retaining it. The circuits wrapped around the spring portions are brought into contact with corresponding circuits on the daughter card by means of cams.

Other more recent ZIF type connectors are disclosed in U.S. Pat. No. 4,911,643 in which the camming action is provided by a shape-memory alloy that is activated by an electrical circuit; and U.S. Pat. No. 5,308,257 that uses a camming slide member.

U.S. Pat. No. 5,195,897 discloses a two-piece connector using flexible film circuitry in which the film is wrapped around a C-shaped spring member. The spring member is spread apart prior to engaging a circuit board by cam bearing surfaces on sidewalls of a support structure associated with the circuit board. A handle attached to the C-shaped spring member provides means for disconnecting the member from its associated circuit board.

The use of a camming type mechanism however increases the complexity of the connector as well as the associated manufacturing cost. In addition, the camming mechanism generally occupies space on the board and at a minimum requires that there be sufficient room surrounding the connector to permit access to it in order to activate the mechanism to permit insertion and withdrawal of the daughter cards. It is desirable, therefore, to have a surface mountable card edge connector using flexible circuitry that does not require the use of a camming mechanism whether mechanically, electrically, or otherwise activated, thereby conserving board space and permitting closer stacking of daughter cards.

SUMMARY OF THE INVENTION

The present invention is directed to a surface mountable high density card edge connector using flexible circuitry that overcomes problems associated with the prior art.

The connector of the present invention includes a housing having a transverse base and end walls, an outer shell member, an inner support member, a resilient member disposed between the support and shell members and a flexible film circuit looped within a card receiving slot and around the outer shell member.

The housing includes an elongate transverse base having opposed ends walls, the end walls preferably including card receiving channels, and board lock members. The C-shaped outer shell member is configured to be received between the housing endwalls. The shell member includes elongate sides extending from a transverse base section and upwardly a selected first distance to leading ends and concluding at free ends defining a card receiving slot of a width greater than the thickness of a card insertable thereinto. The inner support member is also a generally C-shaped member and is disposed centrally within the C-shaped outer member. The support member includes elongate sides extending from a transverse base section upwardly a second selected distance to leading ends, the second distance being less than the first distance so that the sides of the support member are shorter than the corresponding sides of the shell member. The leading ends of the shell and support members are being spaced apart vertically to define a first pair of opposed longitudinal channels therebetween. A resilient member is disposed in each of the channels such that facing portions of the resilient members are spaced closer together than the thickness of the card to be inserted into the card receiving slot. The flexible film circuit assembly is disposed in a loop within the card receiving slot such that exposed circuit traces lie proximate the resilient members whereby upon insertion of a circuit card having circuit pads thereon in registry with the traces on the film, the resilient members provide normal force to maintain electrical interconnection therebetween. Preferably the flexible film layer further includes a plurality of apertured regions such as tabs extending outwardly from the sides, the apertured regions cooperating with film registration pegs on the housing base to accurately position the film in the connector.

In the preferred embodiment, the flexible film circuitry, the inner support member, and the outer shell member are secured to the base by means of eyelets. It is to be understood other means can be used to secure the connector members together. The end walls of the housing in the preferred embodiment preferably include daughter card guide or receiving slots and board lock members or other means for securing a connector to a mother board.

To assure accurate alignment of the circuits of the flexible film assembly and the contact pads of the mother board, the connector housing includes at least a pair of board mounting posts extending from the mounting face. One of the posts is used as a datum for the connector, that is the reference point from which measurements to the respective registration tabs are made to assure precise positioning of the film. The datum post cooperates with a datum mounting post aperture in the circuit board which is used as the reference point for the location of the circuit pads on the board and the other mounting apertures.

To assure accurate alignment of the flexible film circuitry and the contact pads of the daughter card, one of the housing end walls further includes an internal wall extending across the short axis of the base, the circuit side of which is used as a datum, that is the reference point from which measurements are made to locate the apertures for the eyelets in the flexible film assembly and also as a base for locating the mounting posts, which are used as the datum for the registration pegs. The datum wall also functions as a polarization wall for the daughter card and cooperates with a daughter card datum along the circuit side of the slot.

In an alternative embodiment of the invention the inner support member is configured to provide an additional pair of opposed channels for receiving additional resilient members thereby enabling the connector to be used with a daughter card having spaced apart rows of contact pads. The connector is also suitable for use with other configurations of flexible circuitry including circuit assemblies having one or more ground planes such as in a microstrip or stripline configuration as known in the art.

It is an object of the present invention to provide a high density card edge connector for use with flexible circuitry that eliminates the need for a camming mechanism, whether activated mechanically, electrically or by other means known in the art.

It is a further object of the invention to provide a connector that minimizes space requirements on the mother board.

It is another object of the invention to provide a surface mount connector having flexible film circuitry that is compatible with conventional techniques used to surface mount connectors having terminal members.

It is also an object of the invention to provide a connector having means to hold the flexible film in a precise position so that the respective traces in the film are precisely aligned with the corresponding circuit pads on the mother board and daughter card.

It is a further object of the invention to provide a connector utilizing flexible film circuitry that will accommodate any unevenness in the daughter card.

It is yet another object of the invention to provide a connector using flexible film circuitry that can readily accommodate the tolerance ranges associated with card sizes made in accordance with industry standards.

Embodiments of the present invention will now be described by way of example with reference to the accompanying drawings.

DETAILED DESCRIPTION OF THE DRAWINGS

Figure 1:
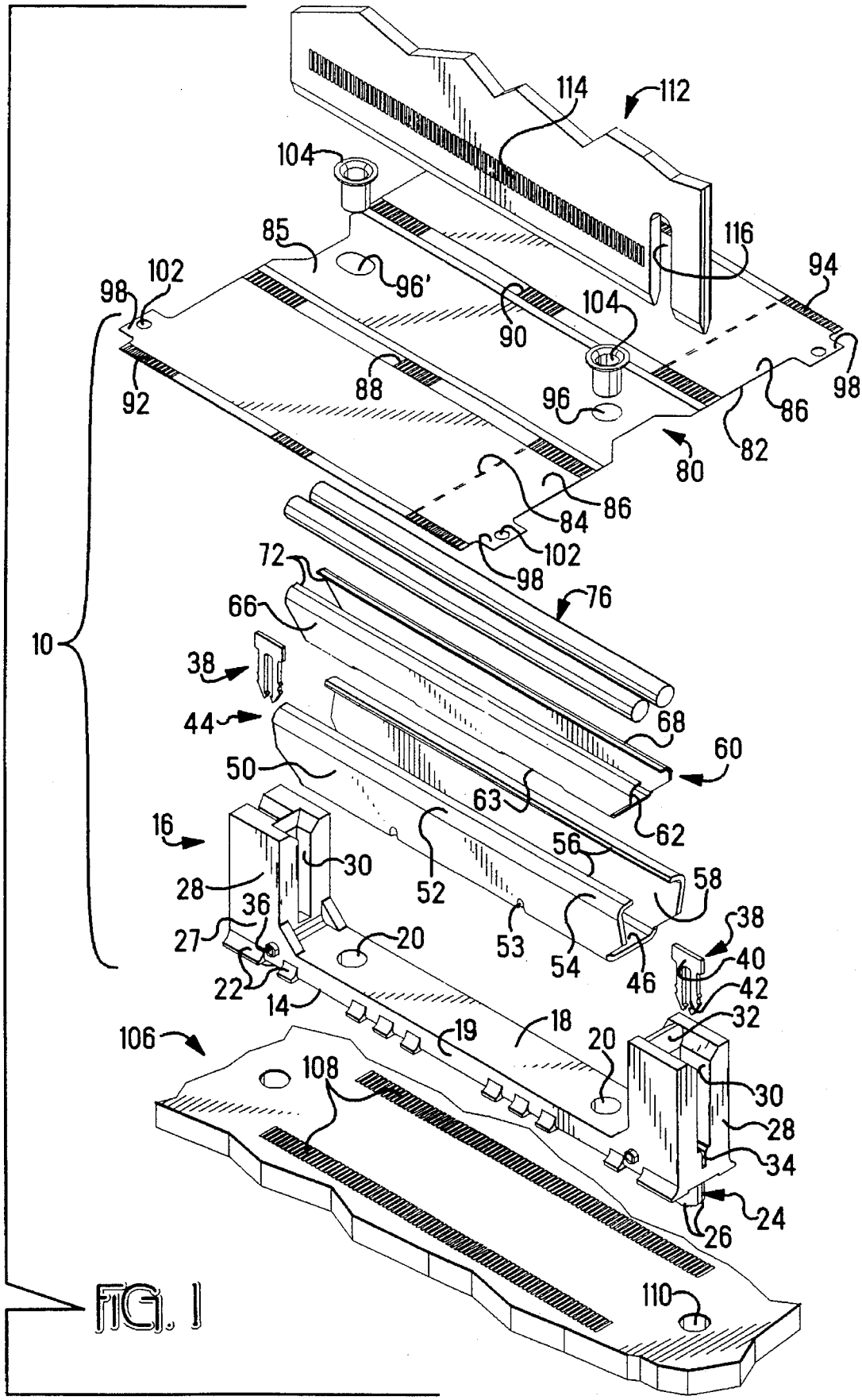
FIG. 1 is a perspective view of the connector of the present invention with the parts exploded from each other and from the mother board and daughter card.
Figure 2:
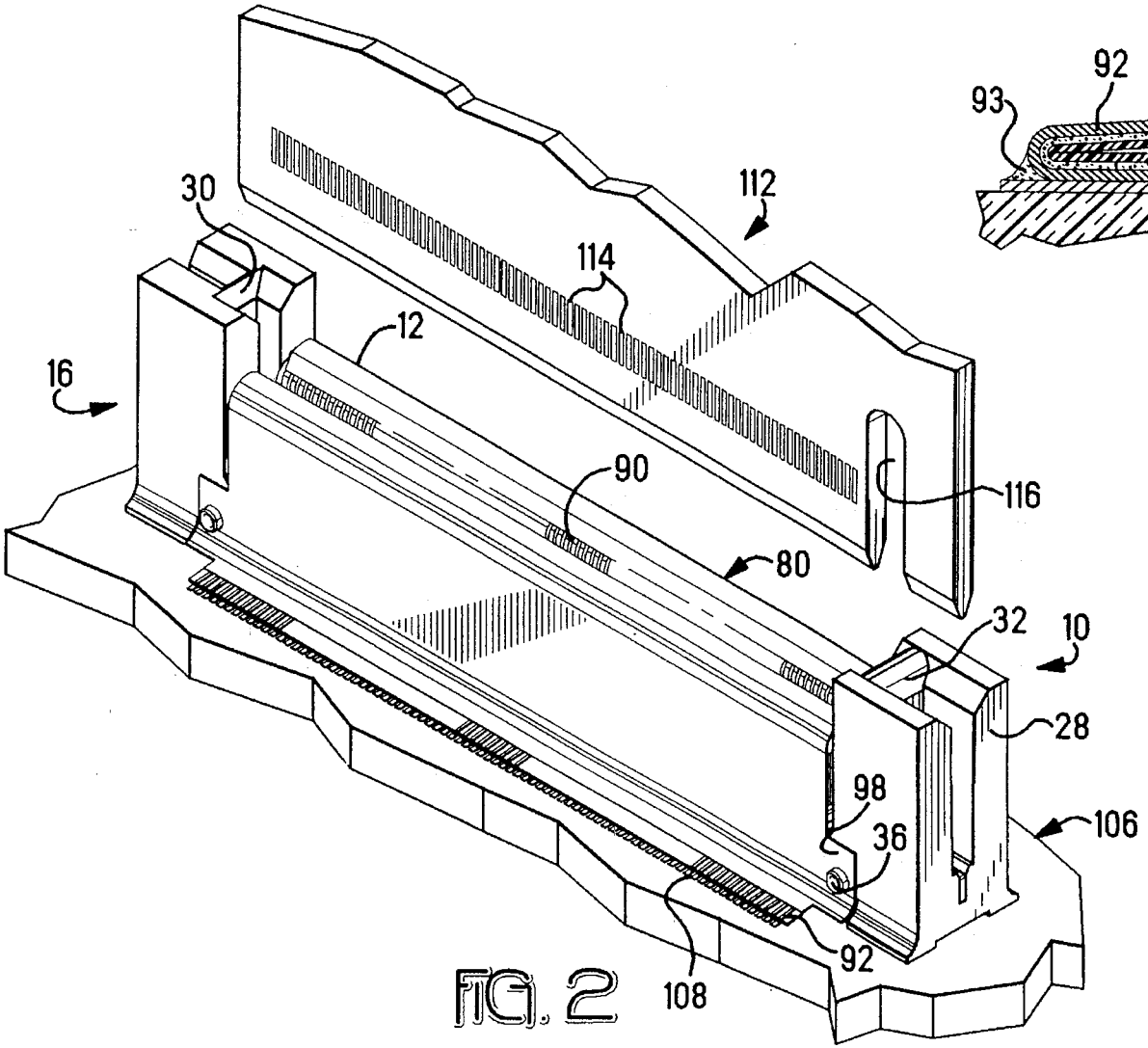
FIG. 2 is a perspective view of the assembled connector of FIG. 1 mounted to the mother board with the daughter board in alignment for mating thereto.
Figure 3:
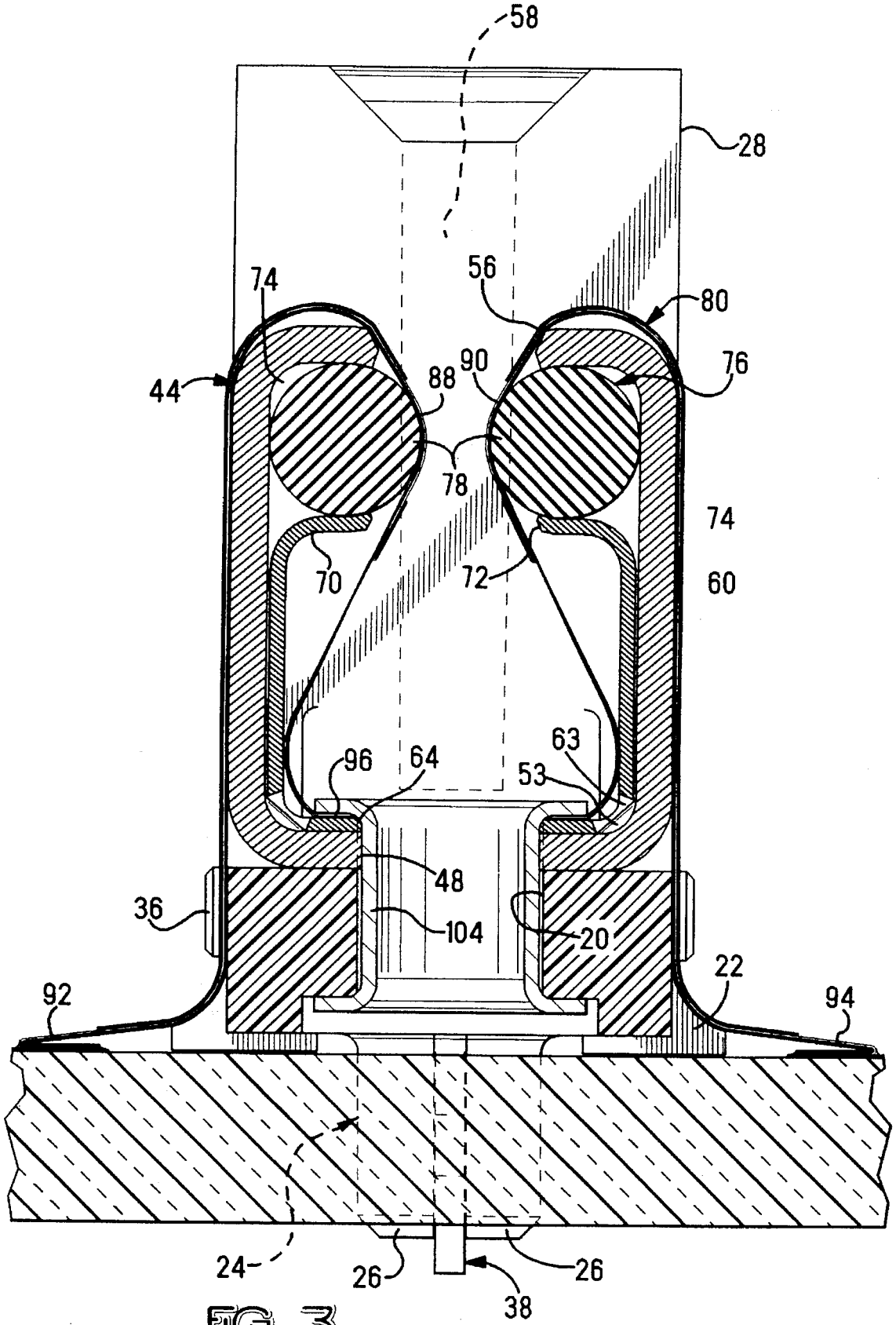
FIG. 3 is a cross-sectional view of the assembled connector of FIG. 2.

Referring now to FIGS. 1, 2 and 3 surface mountable high density card edge connector 10 is designed to interconnect a plurality of circuit traces 108 on a mother board 106 to corresponding traces 114 on a daughter card. 112. Connector 10 has card receiving face 12 and an opposed mounting face 14. The connector 10 includes a housing 16, an outer shell member 44, an inner support member 60, at least one pair of resilient members 76 and a flexible film circuit assembly 80.

Housing 16 includes an elongate transverse base 18 having sidewalls 19 and spaced apart end walls 28. Sidewalls 19 include a plurality of spaced apart radiused film supports 22 that provide support for the flexible film circuitry assembly 80 and to assure the film assembly 80 is maintained in the desired curve for engaging the circuit traces 108 on the mother board 106. In the preferred embodiment end walls 28 include integrally molded card guides 30 for guiding the daughter card 112 into position within the connector 10 and a board lock receiving slot 34. The side surfaces 27 of the end walls 28 further include film mounting pegs 36 used to secure and align the flexible film circuit assembly 80 in the assembled connector 10. Transverse base 18 includes a plurality of apertures 20 extending therethrough for receiving eyelets 104 used in assembling the connector 10 as more fully described below.

In the preferred embodiment one of the end walls 28 includes a polarization wall 32 as known in the art to assure that the daughter card 112 is inserted correctly. The polarization wall 32 is also used as a datum or reference surface from which critical measurements are taken to register the film circuit traces 88,90 with circuit pads 114 of daughter card including the locations of the apertures 96,96' film assembly 80. One of the mounting posts 24 extending from the mounting face 14 of housing 16 is used to register the film traces 92,94 that are to be soldered to circuit pads 108 on mother board 106. In the preferred embodiment the mounting post 24 that is near datum wall 32 is used as the datum post. Datum post 24 in polarization is used as the reference point for locating the film registration pegs 36. The base 18 further shows a board lock 38 having a body 40 and opposed beams 42 which are inserted into the board lock slot 34 and extend through mounting posts 24 on the mounting face 14 of housing 16. In the embodiment shown the mounting posts 24 include a pair of semicylindrical legs 26 joined together at the leading ends thereof. The board lock 38 shown in the preferred embodiment is more fully disclosed in copending patent application U.S. Ser. No. 08/248,262, filed concomitantly herewith. It is to be understood that other means for securing the connector to the housing may also be used.

In the preferred embodiment the housing is made of dielectric material such as a liquid crystal polymer (LCP) or other suitable material that is highly temperature resistant, i.e. can withstand the high temperatures associated with standard soldering techniques for surface mounted connectors, is resistant to chemicals used for cleaning connectors and is flame retardant. One suitable LCP is XYDAR G930, available from Amoco Performance Products, Inc. Other materials as known in the art are also usable.

Figure 5:
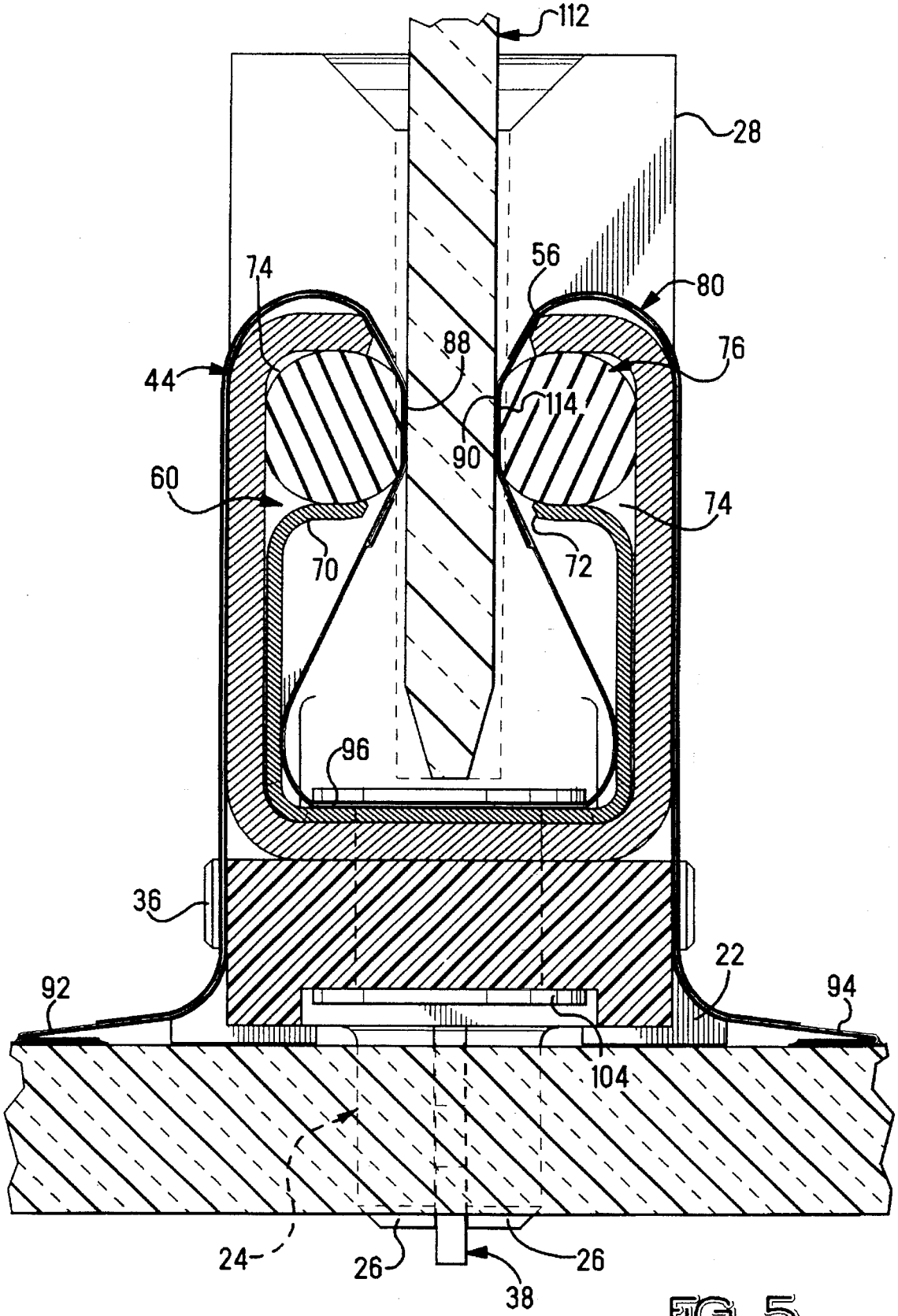
FIG. 5 is a cross-sectional view of the connector similar to that of FIG. 3 and having the daughter card inserted.
Figure 6:
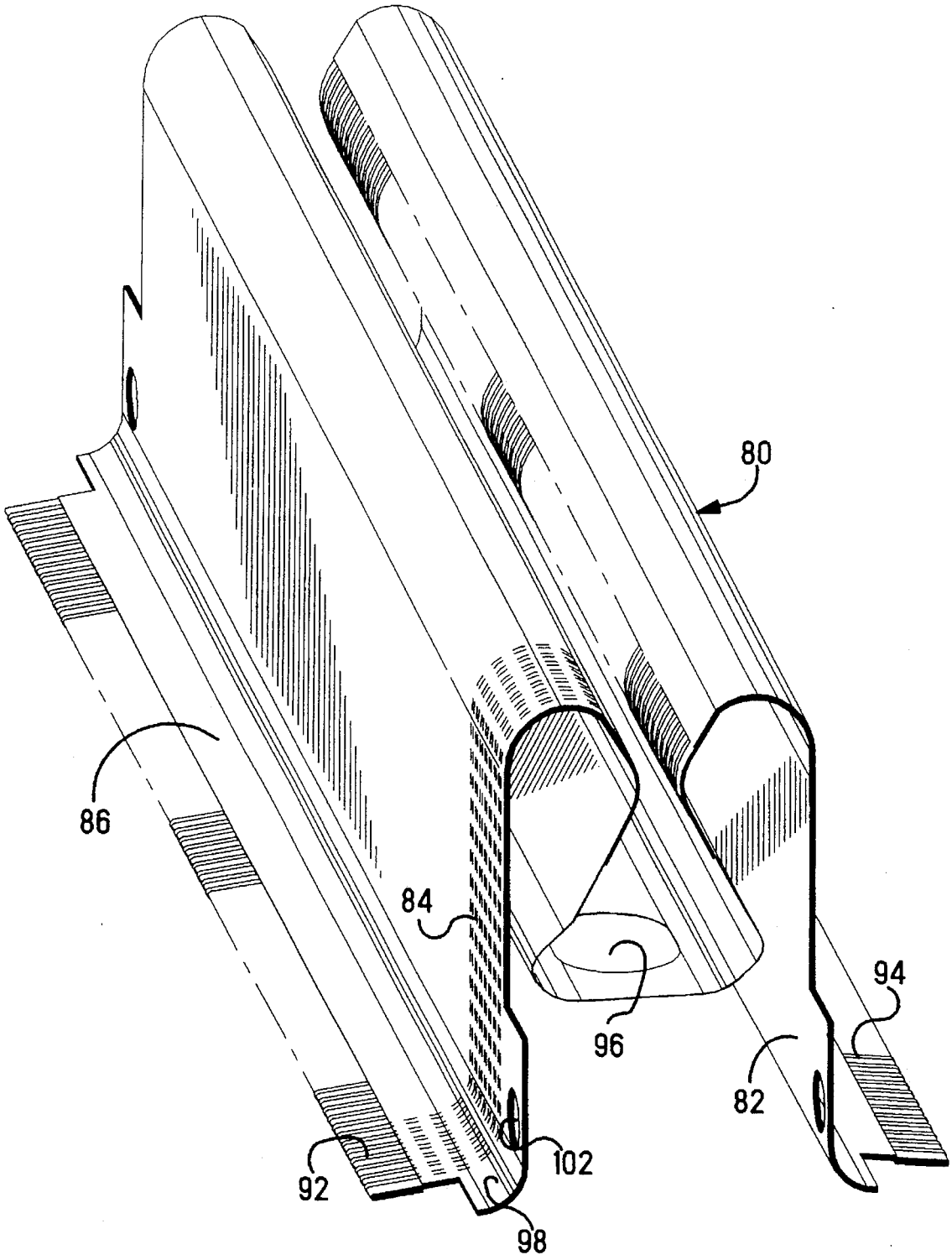
FIG. 6 is a perspective of the flexible film circuitry as it is shaped in the connector.

Outer shell member 44 is a rigid generally C-shaped member configured to be received within the end walls 28 of the housing 16. The shell member 44 has elongate sides 50 extending upwardly from a transverse base 46 for a selected first distance to leading ends 52. The leading ends of shell member 44 have inwardly directed portions 54 and conclude at free ends 56. As shown in FIGS. 3 and 5, the leading ends 56 are curved slightly to conform to the curve of resilient member 76. The parallel free ends 56 define a card receiving slot 58, the slot 58 being of a width selected to be greater than the thickness of a daughter card 112 to be inserted into the slot. As can best be seen in FIG. 3 transverse base 46 also includes apertures 48 for receiving the eyelets 104 during assembly of the connector 10 as more fully described below.

In accordance with the invention the outer shell member 44 is rigid and needs to have sufficient strength to withstand the normal forces associated with insertion of the daughter card 112 and compression of the resilient member 76. In the preferred embodiment, therefore, the shell member is formed of stainless steel having a thickness of about 0.025". Rib like detents 53 are formed along shell sidewalls 50 to further increase the rigidity of the outer shell member 44, as seen in FIGS. 1 and 3. It is to be understood that the shell member may also be made of a dielectric material but in order to achieve the desired strength characteristics, the dielectric walls would need to be considerably thicker, thus increasing the overall size of the connector and the amount of space needed on the mother board.

The inner support member 60 is also a generally C-shaped rigid member configured to be received within the outer shell member 44 and disposed centrally therein. The inner support member 60 has elongate sides 66 extending from a transverse base section 62 that extend upwardly a selected second distance to leading ends 68. Sides 66 include slots 63 which are configured to provide clearance for inwardly directed portion of ribs 53 of outer shell 44. The base 62 of inner support member 60 further includes a plurality of holes extending therethrough for use in assembling the connector as more fully described below. Leading ends 68 includes inwardly directed portions 70 at the leading edges thereof and conclude at free end 72 spaced apart not less than the width of the card receiving slot 58 defined by the outer shell member 44. The side walls of the inner support member 60 are shorter than those of the outer shell member 44 such that when inner support member 60 is positioned within outer shell member 44 there respective inwardly directed portion 70,54 are spaced vertically apart to define a first pair of opposed longitudinal channels 74 therebetween. The essential function of the inner support member 60 is to provide support preferably along the full length of the resilient members 76 that are disposed in the opposed longitudinal channels 74. The free ends 72 of inner support member 60 are curved slightly upwardly to conform to the curve of the resilient member 76. In the preferred embodiment the inner support member is also made from stainless steel and has a thickness of about 0.010 inches, sufficient to withstand the forces exerted by the compression of the resilient members 76.

The resilient members 76 when placed in the channels 74 have portions 78 that face each other and extend into the card receiving slot 58 as best seen in FIG. 3. Suitable materials for the resilient members include extruded elastomeric materials such as for example a fluoroelastomer or the like. The material selected for the resilient members should be one that has minimum deflection, preferably not greater than 20% to prevent the material from taking a compression set, be resistant to chemicals typically used to clean connectors and be stable at the temperatures associated with standard practices for soldering surface mounted connectors. One suitable fluoroelastomer is VITON available from DuPont. Canted coiled springs or other suitable resilient materials may also be used.

FIG. 5 illustrates connector 10 after daughter card 112 has been inserted into card receiving slot 58. As card 112 enters slot 58, the leading edge of the card engages resilient member portion 78, compressing resilient members 76, and forcing the member into the remaining space in channels 74. The insertion of the card 112 provides wiping for the traces 88 and 90 to assure good interconnection between traces 88 and 90 to card traces 114.

The flexible film circuit assembly 80 will be best understood by referring to FIGS. 1, 3, 4 and 6. The assembly 80 is made by means known in the art. The assembly includes a plurality of circuit traces 84 disposed between insulating layers 82,86 with the circuit traces being exposed at least at first selected areas 88,90 for interconnecting to corresponding circuit pads 114 of daughter card 112 and at second areas 92,94 at the outer edges of the continuous strip of film. As can best be seen in FIG. 1 assembly 80 has two sets of circuit traces 84 separated by an insulating portion 85. This structure is intended to be used with a double sided daughter card 112 having a plurality of contact pads 114 on both sides thereof as seen in FIG. 5. It is to be understood that only one set of traces 84 needs to be on the flexible film assembly when single sided daughter cards are used. It is also to be understood that the insulating cover layer 86 may also be eliminated in those applications where safety and environmental conditions permit. The circuitry of flexible film assembly 80 can be readily reconfigurable to meet the needs of a customer by changing the "artwork" used to photographically imaged or otherwise form the traces on the insulating layer, as known in the art. Thus the same housing structure can readily accommodate multiple circuit arrangements.

Figure 4:
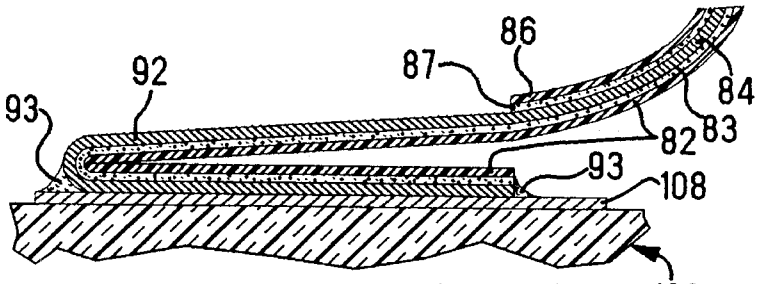
FIG. 4 is an enlarged fragmentary view of the surface mount interconnection between the circuit and the flexible film and the circuit pad on the mother board.

The structure of the flexible film is more clearly shown in FIG. 4. When constructing the flexible film circuitry 80, as known in the art, a layer of adhesive is used to join the layers together. Thus layer 86 includes a layer of adhesive 87 adhering it to the conductive trace 92 on its upper surface and a layer of adhesive 83 adheres the lower layer of flexible material 82 to the trace 92 on its lower surface. As shown in FIG. 4 the underlying adhesive and insulating layers 83,82 extend beneath the exposed conductor layer 92. As can best be seen in FIGS. 3 and 4, only the upper layer 86 of the insulating material and its associated adhesive are removed to expose the circuit traces 92,94,88 and 90 for electrical engagement with a respective pads 108 and 114 on the mother and daughter cards 106,112 respectively. For purposes of clarity, the adhesive layers are not shown in the other figures. The central portion 85 of the flexible film circuitry further includes two apertures 96, 96' for receiving the eyelets 104 when assembling the connector as best seen in FIG. 3. As shown in FIG. 1, one of the apertures 96 is round and the other 96' is oval. As previously discussed, the round aperture 96 is positioned with reference to datum/polarization wall 32. The differences in shape allow for tolerance variations in manufacturing the parts for the connector. The corresponding apertures 48,64 (not shown) in shell member 44 and inner support member 60 have similar configurations. The accuracy in placement of aperture 96 in film assembly 80 is essential in maintaining registration of the closely spaced film circuit traces 88,90 with the daughter card traces 114. The eyelets extend through apertures 96, 96' in film assembly 80, inner support apertures 64, outer support apertures 48 and housing apertures 20 to secure the parts together, as shown in FIG. 3.

Circuit assembly 80 further includes outwardly extending tabs 98 proximate the outer traces 92, 94 that are to be connected to the mother board 106. Tabs 98 include apertures 102 which cooperate with the positioning posts 36 of housing 16 to secure the flexible film assembly 80 to the outer surface of the housing preferably by heat staking. As previously discussed, the locations of the film positioning posts 36 are determined with reference to datum mounting post 24. Securing the film assembly 80 to the housing 16 thereby assures the outer traces positions 92,94 of the film assembly 80 are correctly registered for engagement with the corresponding traces 108 on the mother board 106. As can best be seen in FIGS. 3, 4 and 5, the traces 92,94 with the outer edge of the flexible film assembly 80 are preferably folded near the leading ends thereof so that a portion of the traces 92 will be disposed on the corresponding trace 108 of the circuit board. As seen in FIG. 3, an adjacent film portion extends from the connector housing at positioning posts 36 and past radiused film supports 22 to the far ends of the circuit pads to which the traces are to be soldered and is of a length greater than the straight-line distance from the posts to the far pad ends. In combination with the excess length adjacent film portion, the fold provides a flexible hinged area to relieve stress on the soldered connections as the connector flexes during insertion or withdrawal of the daughter card 112 or owing to differences in rates of thermal expansion of the various materials. It is to be understood that the word "solder" is used in the generic sense and includes other materials such as, for example, conductive adhesives or the like which may be used to effect interconnection of the film traces and circuit board pads.

The traces 92,94 are secured to the outer board with solder, a conductive adhesive or other suitable material that will effect electrical and mechanical interconnection as known in the art.

Figure 7:
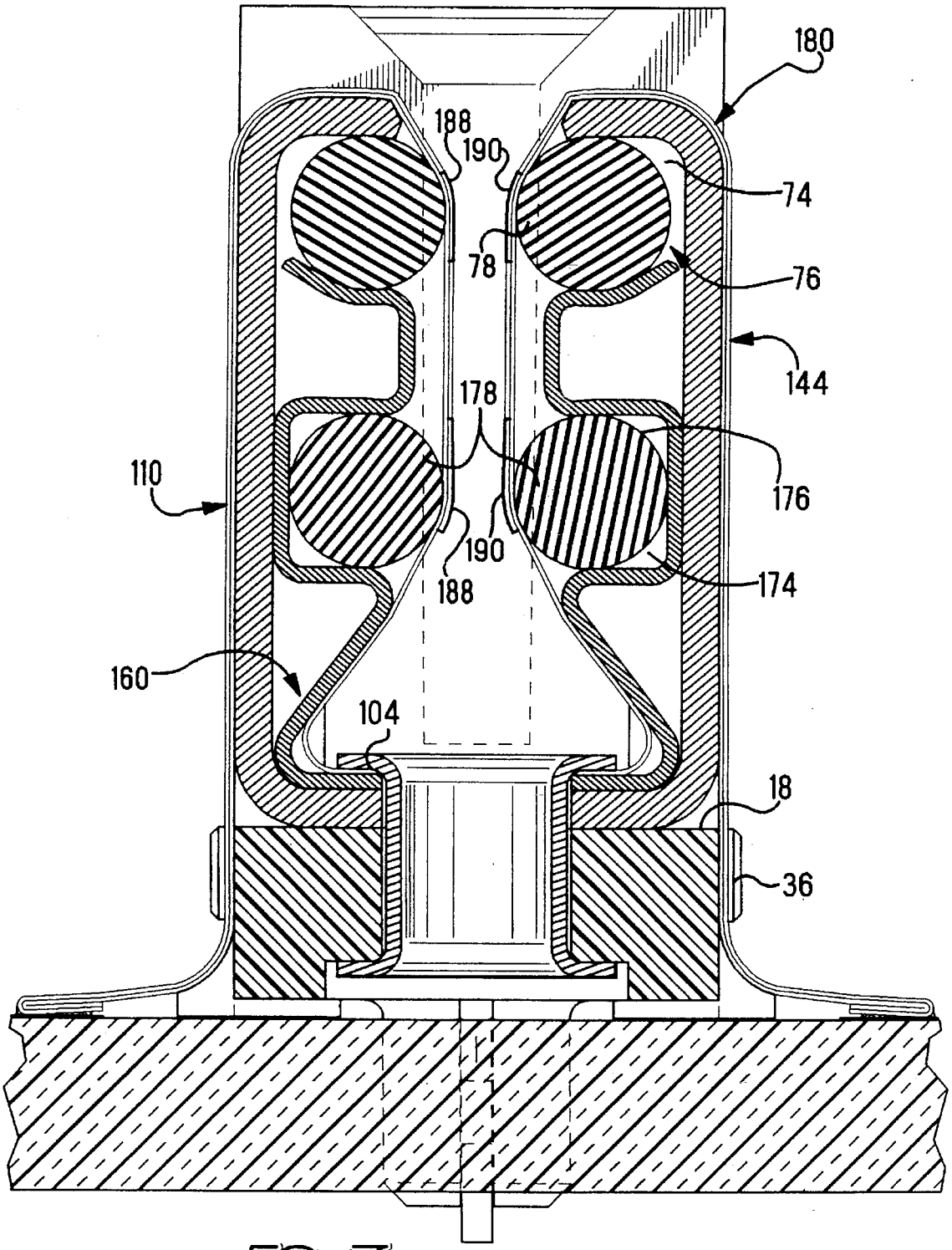
FIG. 7 is a cross-sectional view of an alternative embodiment of the connector of the present invention for use with a dual-row daughter card.

FIG. 7 is an alternative embodiment 110 of the connector in which the inner support member 160 is formed to include a second channel for receiving a resilient member, intermediate the base and leading ends thereof. In this embodiment the flexible film assembly 180 includes two sets of film circuit pads, 188, 190 for interconnection to two spaced apart rows of contact pads on the same side of a daughter card (not shown).

Figure 8:
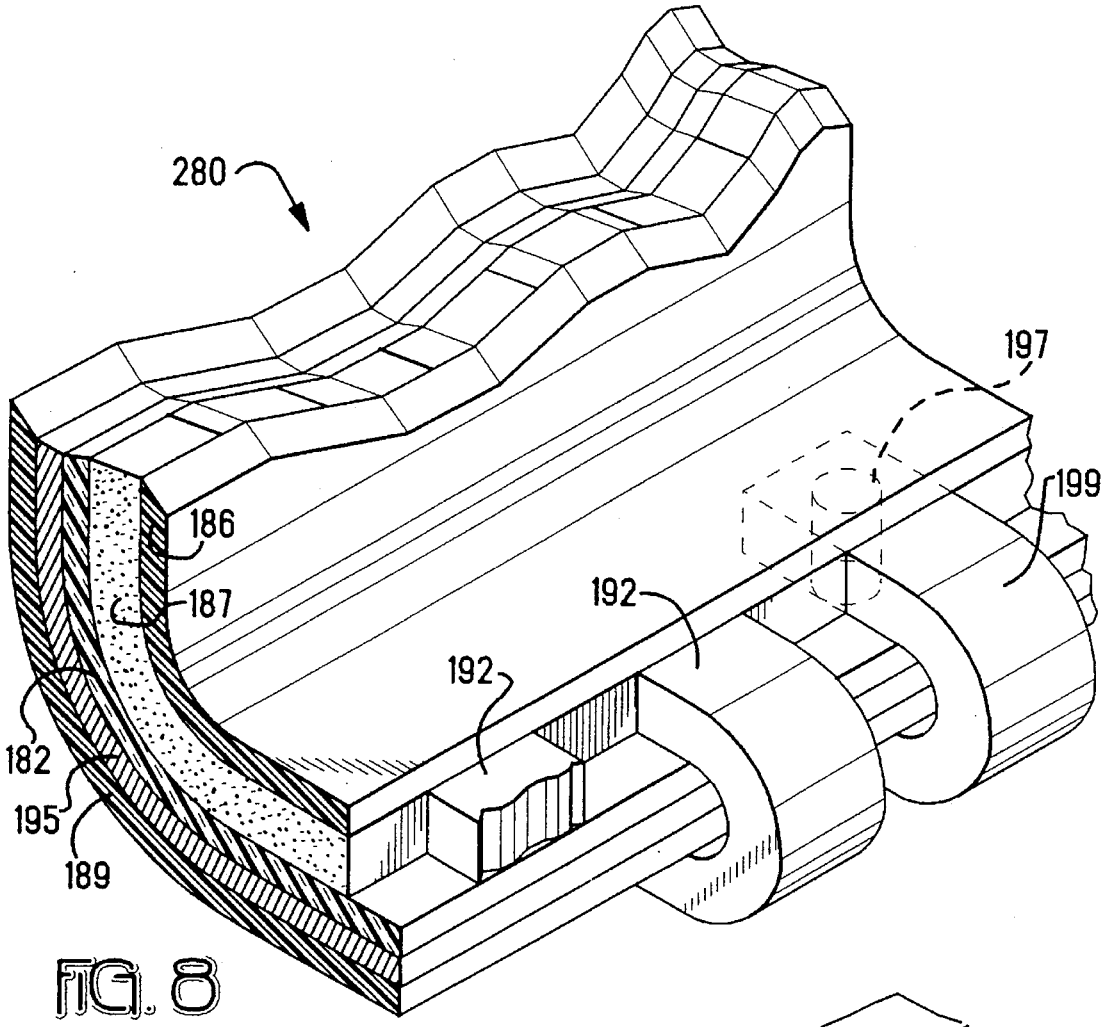
FIG. 8 is a diagrammatic view of an alternative embodiment of the flexible film structure using a single ground plane.
Figure 9:
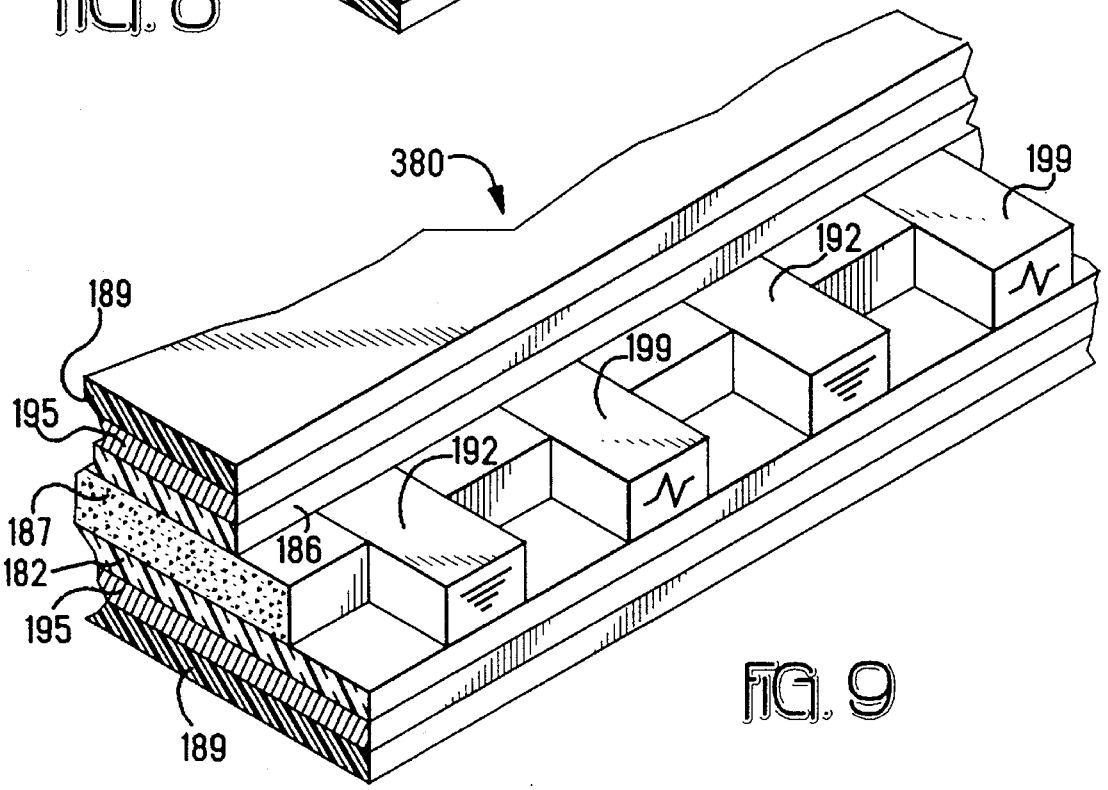
FIG. 9 is a diagrammatic view of a further alternative view of the flexible film structure having a ground plane on both sides of the circuit layer.

FIGS. 8 and 9 show diagrammatic representations of two alternative embodiments of the flexible film assembly 280, 380. In embodiment 280, shown in FIG. 8, the film assembly includes an upper insulating layer 186, adhesive layer 187 surrounding traces 192 and 197 (greatly enlarged), a middle insulating layer 182, a ground plane 195 and a lower insulating layer 189. Circuit trace 199 is interconnected to ground plane 195 by means of a via 197 shown in phantom. Embodiment 280 defines a micro-strip flexible circuitry.

In embodiment 390, shown in FIG. 9, the film assembly includes two additional layers, a second ground plane 195 and a further insulating layer 189, such that the conductors 192,199 are sandwiched between ground planes 195. Selected circuit traces and ground planes are interconnected with vias (not shown) in the same manner as previously described. Embodiment 380 defines strip-line flexible circuitry.

It is thought that the card edge connector having flexible circuitry of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A surface mountable high density card edge connector comprising:

a housing including an elongate transverse base and opposed endwalls;

a generally C-shaped outer shell member configured to be received between said endwalls of said housing, said shell member having elongate sides extending from a transverse base section upwardly a selected first distance to leading ends, and including inwardly directed portions at the leading edges thereof and concluding at free ends defining a card receiving slot of selected width therebetween greater than the thickness of a card insertable thereinto;

a generally C-shaped inner support member configured to be received within said outer shell member and disposed centrally therein, said support member having elongate sides extending from a transverse base section upwardly a selected second distance to leading ends and including inwardly directed portions spaced apart not less than the width of said card receiving slot, said second distance being less than said first distance so that said sides of said support member are shorter than those of said shell member with their respective inwardly directed portions spaced apart vertically to define a first pair of opposed longitudinal channels therebetween;

a resilient member disposed in each of said first pair of channels such that facing portions of each said resilient member are spaced closer together than the thickness of a card to be inserted into said card receiving slot; and a flexible film circuit assembly including at least one layer of insulating film having a plurality of circuit traces disposed thereon, said circuit traces being exposed at least at a first selected region intermediate outer ends thereof for interconnection to corresponding pads on said circuit card, said film assembly being disposed in a loop between the leading edges of said shell and support members and around said sides of said shell member such that said exposed circuitry at said first selected region is located in said card receiving slot and proximate said resilient members, whereby upon inserting a circuit board having circuit pads thereon in registry with said pads of said film assembly into said card receiving slot, said resilient members provide normal force to maintain electrical interconnection therebetween.

2. The surface mountable high density card edge connector of claim 1 wherein said housing includes at least one film registration peg on each side thereof proximate said mounting face, each said peg being precisely located with respect to a reference datum of said connector itself cooperable with a datum of the circuit board, and said film assembly includes exposed circuit traces at at least one second selected region proximate at least one outer end of said assembly for electrical connection to corresponding circuit pads on another circuit board, said film assembly including at least one apertured portion proximate each said at least one second selected region, each apertured portion being configured for cooperating with a corresponding registration peg upon assembly to the connector, for holding said traces at said second regions precisely registered with respect to said circuit pads on said another circuit board upon board mounting.

3. The surface mountable high density card edge connector of claim 2 wherein said at least one apertured portion of said assembly is a tab extending outwardly from a lateral edge of said film assembly.

4. The surface mountable high density card edge connector of claim 2 wherein each side of said housing includes two film registration pegs and said film assembly includes an apertured portion configured for cooperating with each corresponding registration peg upon assembly to the connector, for holding said traces at said second regions precisely registered with respect to said circuit pads on said another circuit board upon board mounting.

5. The surface mountable high density card edge connector of claim 1 wherein said sides of said inner support member are configured to define at least a second pair of opposed longitudinal channels intermediate said base and said first pair of channels, said pair of second channels being in communication with said card receiving slot, each of said at least second pair of channels having a resilient member disposed therein such that facing portions of each said resilient member are spaced closer together than the thickness of said card inserted into said slot.

6. The surface mountable high density card edge connector of claim 1 wherein said film assembly further includes exposed circuit traces at a selected region proximate at least one outer end of said assembly for electrical connection to corresponding circuit pads on another circuit board, said exposed traces being carried by at least one layer of insulating film, an end portion of said selected region being folded such that end portions of said exposed traces extend toward said connector and are directly opposed to said corresponding circuit pads for soldering, while an adjacent portion of said film assembly is joined to said end portion and extends toward said connector overlying said end portion, providing relief from stress to soldered interconnections of said exposed trace end portions to said corresponding circuit pads.

7. A surface mountable high density card edge connector comprising:

a housing including an elongate transverse base and opposed endwalls;

a generally C-shaped outer shell member configured to be received between said endwalls of said housing, said shell member having elongate sides extending from a transverse base section upwardly a selected first distance to leading ends, and including inwardly directed portions at the leading edges thereof and concluding at free ends defining a card receiving slot of selected width therebetween greater than the thickness of a card insertable thereinto;

a generally C-shaped inner support member configured to be received within said outer shell member and disposed centrally therein, said support member having elongate sides extending from a transverse base section upwardly a selected second distance to leading ends and including inwardly directed portions at leading edges thereof concluding at free ends spaced apart not less than the width of said card receiving slot, said second distance being less than said first distance so that said sides of said support member are shorter than those of said shell member with their respective inwardly directed portions spaced apart vertically to define a first pair of opposed longitudinal channels therebetween;

a resilient member disposed in each of said first pair of channels such that facing portions of each said resilient member are spaced closer together than the thickness of a card to be inserted into said card receiving slot; and a flexible film circuit assembly having a plurality of circuit traces disposed between insulating layers, said circuit traces being exposed at least at a first selected region intermediate said ends for interconnection to corresponding pads on said circuit card, said film assembly being disposed in a loop between the leading edges of said shell and support members and around said sides of said shell member such that said exposed circuitry at said first selected region is located in said card receiving slot and proximate said resilient members, whereby upon inserting a circuit board having circuit pads thereon in registry with said pads of said film assembly into said card receiving slot, said resilient members provide normal force to maintain electrical interconnection therebetween.

8. The surface mountable high density card edge connector of claim 7 wherein said housing includes at least one film registration peg on each side thereof proximate said mounting face, each said peg being precisely located with respect to a reference datum of said connector itself cooperable with a datum of the circuit board, and said film assembly includes exposed circuit traces at at least one second selected region proximate at least one outer end of said assembly for electrical connection to corresponding circuit pads on another circuit board, said film assembly including at least one apertured portion proximate each said at least one second selected region, each apertured portion being configured for cooperating with a corresponding registration peg upon assembly to the connector, for holding said traces at said second regions precisely registered with respect to said circuit pads on said another circuit board upon board mounting.

9. The surface mountable high density card edge connector of claim 8 wherein said at least one apertured portion of said assembly is a tab extending outwardly from a lateral edge of said film assembly.

10. The surface mountable high density card edge connector of claim 8 wherein each side of said housing includes two film registration pegs and said film assembly includes an apertured portion configured for cooperating with each corresponding registration peg upon assembly to the connector, for holding said traces at said second regions precisely registered with respect to said circuit pads on said another circuit board upon board mounting.

11. The surface mountable high density card edge connector of claim 7 wherein said sides of said inner support member are configured to define at least a second pair of opposed longitudinal channels intermediate said base and said first pair of channels, said pair of second channels being in communication with said card receiving slot, each of said at least second pair of channels having a resilient member disposed therein such that facing portions of each said resilient member are spaced closer together than the thickness of said card inserted into said slot.

12. The surface mountable high density card edge connector of claim 7 wherein said film assembly further includes exposed circuit traces at a selected region proximate at least one outer end of said assembly for electrical connection to corresponding circuit pads on another circuit board, said exposed traces being carried by at least one layer of insulating film, an end portion of said selected region being folded such that end portions of said exposed traces extend toward said connector and are directly opposed to said corresponding circuit pads for soldering, while an adjacent portion of said film assembly is joined to said end portion and extends toward said connector overlying said end portion, providing relief from stress to soldered interconnections of said exposed trace end portions to said corresponding circuit pads.

13. The surface mountable high density card edge connector of claim 7 wherein said film assembly further includes a further insulating film layer having a ground plane disposed thereon, said ground plane being sandwiched between said further insulating layer and one of said insulating layers adjacent said circuit traces thereby defining micro-strip flexible circuitry.

14. The surface mountable high density card edge connector of claim 7 wherein said film assembly further includes two further insulating film layers, each having a ground plane disposed thereon, said insulated circuit traces being sandwiched between said ground planes and said further insulating layers, thereby defining strip-line flexible circuitry.

15. A surface mountable connector comprising:

a connector housing having a mating face and a mounting face; and a flexible film assembly affixed to said connector housing for electrical connection to another electrical article;

said housing including at least one film registration peg on each side thereof proximate said mounting face, each said peg being precisely located with respect to a reference datum of said connector itself cooperable with a datum of said another electrical article; and said film assembly including exposed circuit traces at at least one selected region proximate at least one outer end of said assembly for electrical connection to corresponding circuit pads of said another electrical article, said film assembly including at least one apertured portion proximate each said at least one selected region, each apertured portion being configured for cooperating with a corresponding registration peg upon assembly to the connector, for holding said traces at said regions precisely registered with respect to said circuit pads on said another electrical article upon mounting thereto.

16. The surface mountable connector of claim 15 wherein said at least one apertured portion of said assembly is a tab extending outwardly from a lateral edge of said film assembly.

* * * * *